United States Patent [19]

Forman

[11] Patent Number: 4,782,830

[45] Date of Patent: Nov. 8, 1988

[54] SNORKEL

[76] Inventor: Bruce J. Forman, 4455 Jasmine Ave., Culver, Calif. 90230

[21] Appl. No.: 933,376

[22] Filed: Nov. 21, 1986

[51] Int. Cl.[4] ..... B63C 11/16

[52] U.S. Cl. ..... 128/201.11

[58] Field of Search ..... 128/201.11, 201.27, 128/202.14; 441/102, 103, 104, 105

[56] References Cited

U.S. PATENT DOCUMENTS

| | | | |
|---|---|---|---|
| 156,599 | 11/1874 | Schmitz | 128/201.11 |
| 1,268,806 | 6/1918 | Vukosav | 441/105 |
| 4,583,536 | 4/1986 | Jan | 128/201.11 |

FOREIGN PATENT DOCUMENTS

| | | | |
|---|---|---|---|
| 164933 | 12/1949 | Austria | 128/201.11 |
| 2350536 | 10/1973 | Fed. Rep. of Germany | 128/201.11 |
| 415452 | 10/1946 | Italy | 128/201.11 |

*Primary Examiner*—Kyle L. Howell
*Assistant Examiner*—Timothy G. Philips
*Attorney, Agent, or Firm*—Robert J. Schaap

[57] ABSTRACT

A snorkel which is capable of being used for diving in an underwater environment and where the positional attitude of the diver may change substantially in an underwater environment. The snorkel is generally comprised of an elongate breathing tube with a mouth piece on the lower end of that breathing tube. A secondary tube is generally parallel to the breathing tube and is connected to the upper end thereof by a U-shaped connecting section. The snorkel also comprises an upwardly opening air intake and exhaust chamber through which the breathing tube extends. The secondary tube is also connected to the upwardly opening air chamber through a port close to the lower end of the chamber.

2 Claims, 3 Drawing Sheets

SNORKEL

BACKGROUND OF THE INVENTION

1. Field of the Invention

This invention relates in general to certain new and useful improvements in snorkels, and more particularly, to snorkels of the type in which an underwater swimmer can adopt a variety of swimming positional attitudes without a fear of water inhalation.

2. Brief Description of the Prior Art

The snorkel is a very common breathing device for an underwater swimmer or diver. Most of the prior art snorkels are generally comprised of an elongate breathing tube which is adapted for generally vertical disposition when the diver is normally swimming in a prone position, i.e. parallel to the water surface. Usually, one end of the snorkel breathing tube is adapted for positioning above the water surface. A mouth piece is located on the opposite end of the snorkel breathing tube, e.g. below the water surface, for engagement by the teeth and lips of the user so that inhalation and exhalation can take place through the same elongate breathing tube.

In many of the prior art snorkels, the breathing tube was longer than desirable for efficient operation. As a result, exhaled carbon dioxide became trapped in the breathing tube upon exhalation as a result of a "head" of air above the carbon dioxide. This resulted in what is commonly known as "carbon dioxide build-up". This carbon dioxide was then re-inhaled in the next breath by the diver, thereby sacrificing oxygen intake which was needed.

In addition to the foregoing, the breathing tubes in these prior art snorkels were also of insufficient diameter, thereby causing the diver to exert a much greater amount of effort than should have been required in order to clear the breathing tube of water. Accordingly, during periods of high stress, the diver encountered deep breathing problems as a result of the higher oxygen demand. Moreover, the insufficient diameter of the breathing tube did not allow an unrestricted flow of air and/or water during clearing.

This type of prior art snorkel device is otherwise moderately effective so long as the attitude of the diver, that is, the position which the diver maintains relative to the water surface remains the same, that is, in a prone position. However, when the swimmer dives to a lower depth such that the upper end of the snorkel tube is under the water, or if the swimmer should change his diving attitude, such that he is vertical, or positioned at some angle with respect to the water surface, other than a horizontal or prone position, there is a tendency for the snorkel tube to fill with water.

In order to obviate this problem, there have been check valves and similar devices which have been proposed for use with snorkels to prevent the swimmer from inhaling water which may have accumulated in the snorkel tube and which valves or other devices are also adapted for purging water from the snorkel tube. Purging generally takes place by a large blast of expelled air from the swimmer which is presumed to force the water out of the snorkel tube when the swimmer has surfaced.

Exemplary of these prior art snorkels is U.S. Pat. No. 4,278,080 to Schuch which discloses a diving snorkel having a purge valve located in a bypass conduit. U.S. Pat. No. 3,768,504 to Reutsch, Jr., discloses a snorkel type breathing tube with a check valve to prevent ingress of water when the diver is submerged. U.S. Pat. No. 2,753,865 to Van Der Kogel discloses an underwater breathing device in the nature of a snorkel which may be disassembled for purposes of packing or storage and which includes a vertically extensible section.

There are other forms of prior art snorkels which include an elongate water column but which require exhalation efforts to clear water from the snorkel tube after re-emerging above the water surface. There are other types of snorkels which include traps of types to preclude water from being inhaled by the diver, regardless of the diving positional attitude. One of the more pertinent of these prior art snorkels is hereinafter described in more detail.

In substance, many of the previous commercially available prior art snorkels failed the practical test of usage and therefore, have had a very short market availability. In large measure, many of the prior art designs were inadequate as a result of long or narrow breathing tubes which thereby increased the difficulty in clearing the tube or which resulted in carbon dioxide build-up. Several designs incorporated valves, such as flapper valves, ball-check valves, etc. While the designs appeared to be adequate from a design consideration, they did not overcome many of the problems which were inherent in the prior art as a result of valve sticking, improper proper valve seating, or the like. Moreover, sand or other debris became an obstruction which prevented proper seating and hence sealing. As a result, these prior art snorkels were not fully effective for their intended purposes.

OBJECTS OF THE INVENTION

It is, therefore, one of the primary objects of the present invention to provide a snorkel which permits a user to assume a prone swimming attitude or any other positional attitude including a vertical attitude without fear of water inhalation.

It is another object of the present invention to provide a snorkel of the type stated which includes a trap to preclude water from extending down into the mouth piece of the user, but which still nevertheless permits exhalation and inhalation of air directly through any water which may be collected in a water trap.

It is a further object of the present invention to provide a snorkel of the type stated which includes an elongate breathing tube end upwardly opening intake and exhaust chamber and a secondary tube which extends generally parallel to the elongate breathing tube end which are connected in such manner as to provide a water trap but which nevertheless permits easy air exhalation and inhalation.

It is a further object of the present invention to provide a snorkel of the type stated which can be constructed at a relatively low cost, but which is also highly efficient in operation.

It is an additional object of the present invention to provide a snorkel of the type stated which is adaptable for use in a large number of different underwater environments end which can be equipped with other conventionally available auxillary equipment.

With the above and other objects in view, my invention resides in the novel features of form, construction, arrangement and combination of parts presently described and pointed out in the claims.

BRIEF SUMMARY OF THE DISCLOSURE

A snorkel capable of being used for diving in underwater environments and which is designed with a water trap to reduce the risk of water inhalation when the user assumes a variety of attitudes other than a horizontal or prone attitude in the water. The term "attitude", as used herein, is used in the same sense as the direction end angular position of a vehicle, such as an airplane. In this case, the diver can assume essentially any attitude in the water relative to the surface of the water that an airplane can assume in a body of air.

The snorkel of the present invention comprises a chamber which also functions as a water trap. The chamber is upwardly opening end functions as an intake and exhaust chamber. An elongate breathing tube or so-called "air column" forms part of the snorkel of the invention. In one embodiment, the breathing tube extends through the upwardly opening intake and exhaust chamber. A mouth piece is located on the lower end of this breathing tube and is adapted to be engaged by the mouth of a user for inhaling fresh air and expelling exhausted air through the breathing tube.

The snorkel of the invention also comprises a secondary tube which is generally parallel to the breathing tube and is connected to the upper end of the breathing tube in air flow communcation therewith. In like manner, the secondary tube is also connected to the upwardly opening intake and exhaust chamber through a port located toward the lower end of this chamber.

In a more preferred embodiment of the invention, a U-shaped connecting section connects the upper end of this breathing tube to the secondary tube which is located outwardly of the upwardly opening chamber. The secondary tube also has an L-shaped section or a U-shaped section which connects the lower end of the secondary tube to the intake and exhaust chamber. In all cases, the lower end of the secondary tube is connected to the intake and exhaust chamber at a point below the open upper end of the chamber.

In another embodiment of the invention, a liquid-tight swivel joint may connect the elongate breathing tube to the chamber to thereby enable rotational movement therebetween while yet maintaining a liquid-tight seal therebetween.

The chamber along with the elongate tube and the secondary tube actually form somewhat of an S-trap of the type used in plumbing fixtures. While these components in combination may not necessarily have the same appearance as an S-trap plumbing fixture the device of the invention, has common principles to that used in plumbing. The snorkel of the invention in this case, precludes water from being passed to the mouth piece, but does permit inhalation and exhalation of air even through some water which may be entrapped in the chamber.

This invention possesses many other advantages and has other purposes which may be made more clearly apparent from a consideration of the forms in which it may be embodied. These forms are shown in the drawings forming part of and accompanying the present specification. They will now be described in detail for purposes of illustrating the general principles of the invention, but it is to be understood that such detailed descriptions are not to be taken in a limiting sense.

BRIEF DESCRIPTION OF THE DRAWINGS

Figure 1:
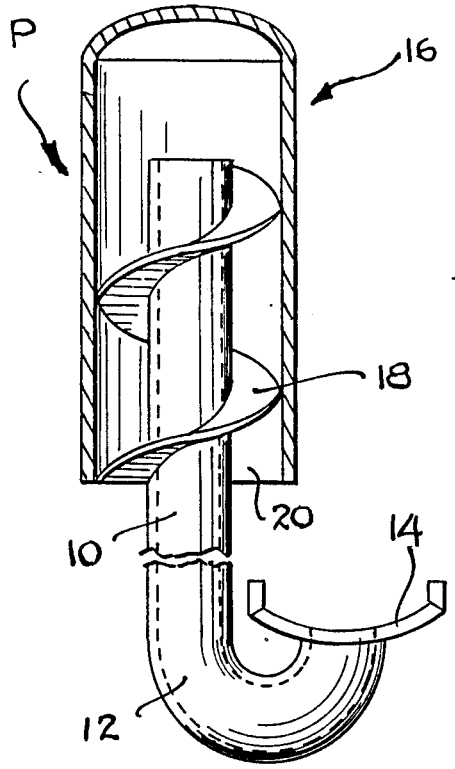
FIG. 1 PRIOR ART
Figure 4:
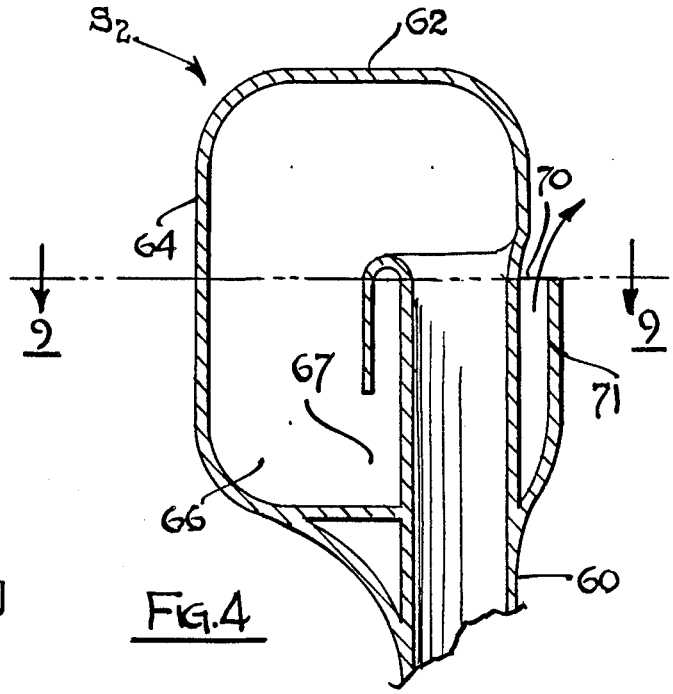
Figure 2:
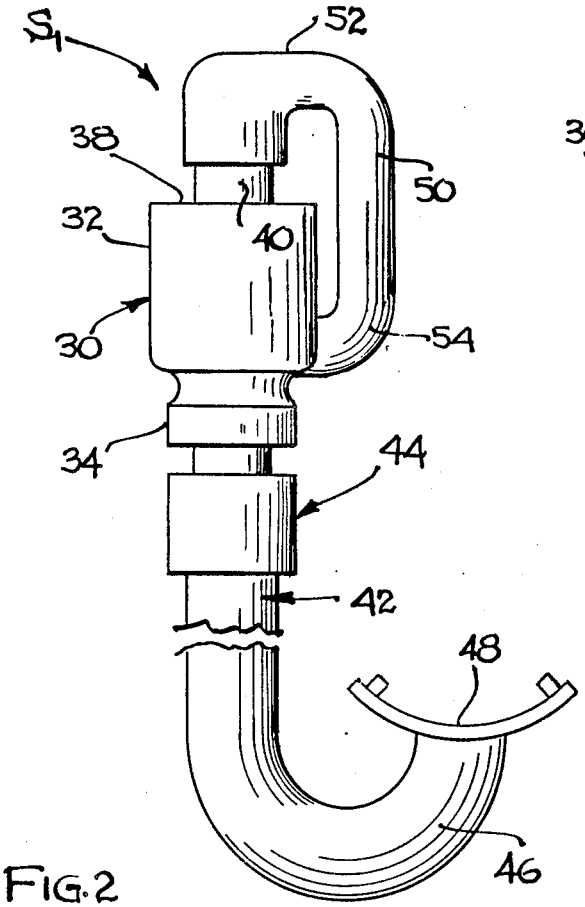
Figure 3:
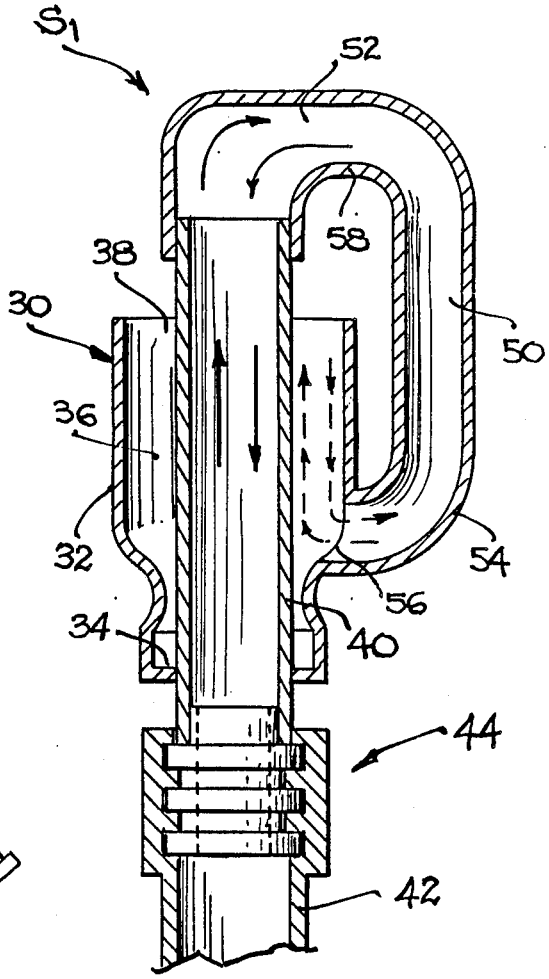
Figure 5:
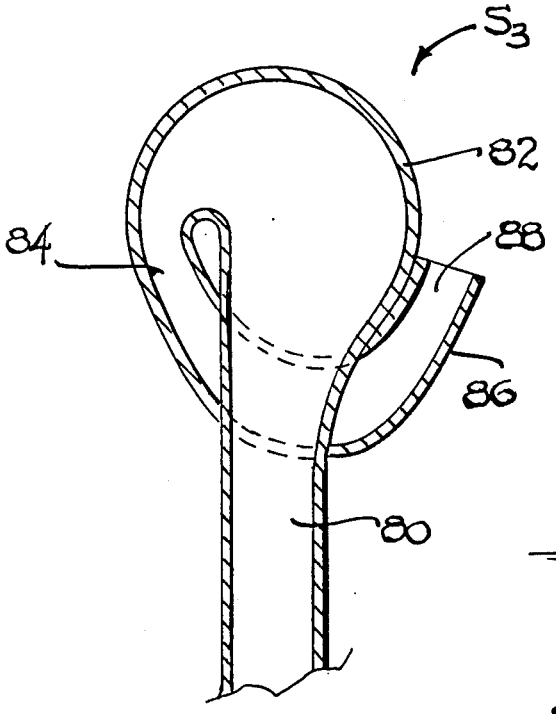
Figure 6:
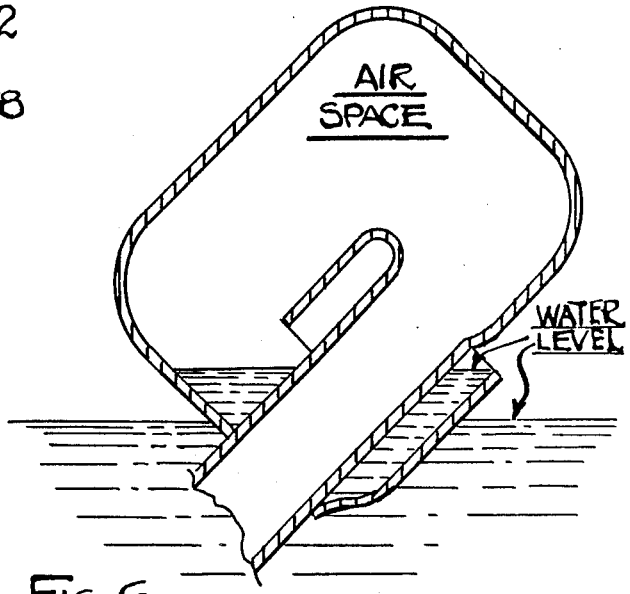
Figure 8:
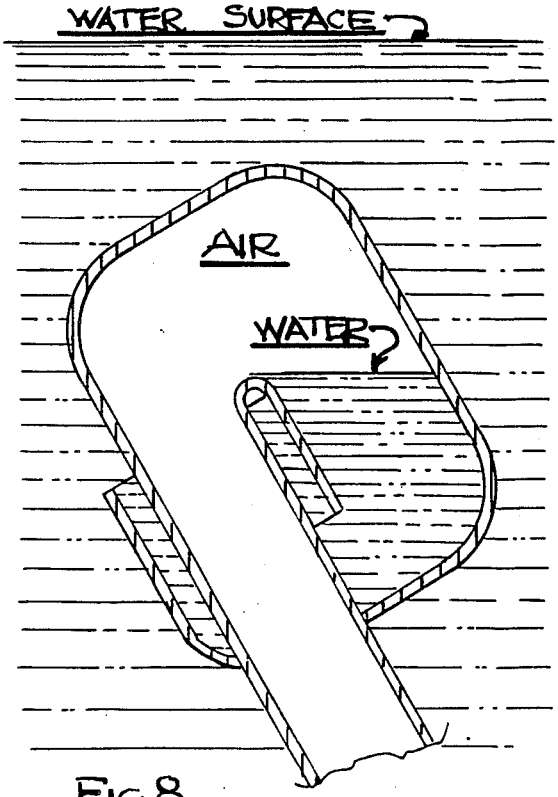
Figure 7:
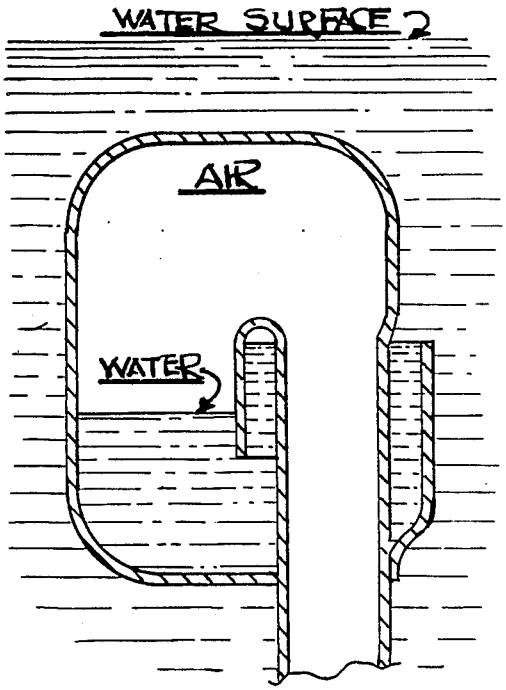
Figure 9:
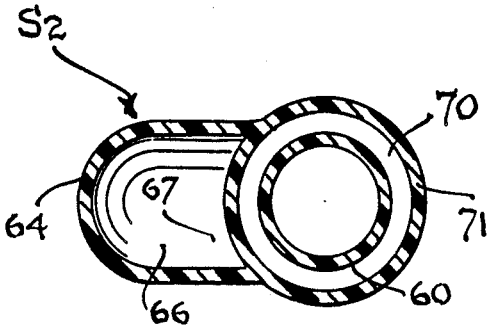
Figure 10:
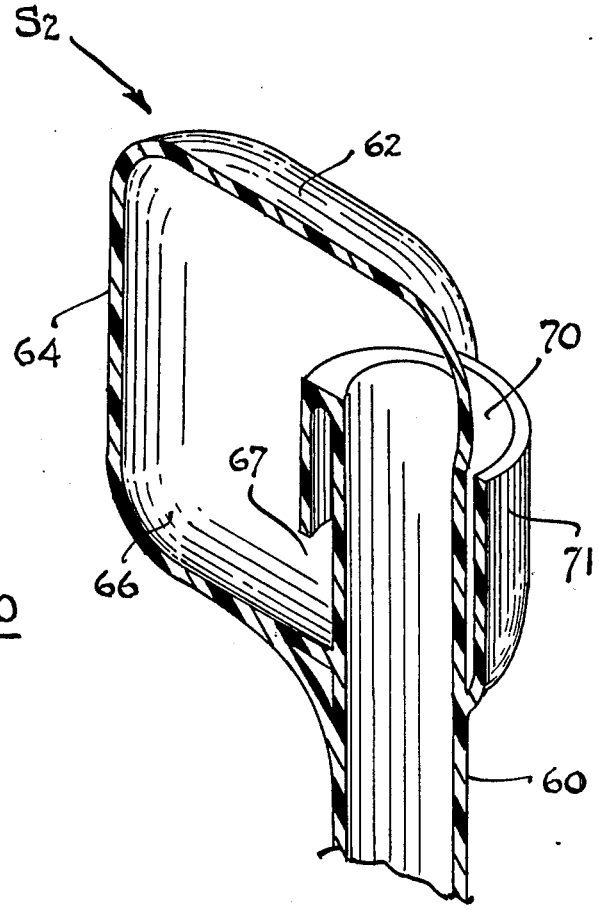

Having thus described the invention in general terms, reference will now be made to the accompanying drawings in which:

FIG. 1 is a side elevational view, partially broken away and in section of a prior art snorkel;

FIG. 2 is a side elevational view of a snorkel constructed in accordance with and embodying the present invention;

FIG. 3 is a vertical sectional view of the snorkel of FIG. 2;

FIG. 4 is a vertical sectional view of a modified form of snorkel constructed in accordance with and embodying the present invention;

FIG. 5 is a vertical sectional view of still another embodiment of a snorkel constructed in accordance with and embodying the present invention;

FIGS. 6 through 8 are schematic views showing the snorkel of the invention in certain positions when used in a body of water;

FIG. 9 is a horizontal sectional view taken away along Line 9—9 of FIG. 4; and FIG. 10 is a perspective view broken away and in section and showing the details of construction of the snorkel of FIG. 4.

DETAILED DESCRIPTION OF PREFERRED EMBODIMENTS

Referring now in more detail and by reference characters to the drawings which illustrate several preferred embodiments of the invention, reference will now be made to FIG. 1 which illustrates one of the more relevant prior art snorkels P.

The prior art snorkel P includes an elongate breathing tube 10 which is provided with a lower somewhat U-shaped section 12 and the latter of which is provided with a mouth piece 14 adapted to be engaged by the teeth and the lips of a user. At its upper end, the breathing tube 10 extends into a somewhat cylindrically shaped housing 16 which functions as a trap. The housing is closed at its upper end and is open at its lowermost end and concentrically receives the breathing tube 10 which extends therethrough and opens in close proximity to the closed upper end of the housing 16.

A somewhat helical plate 18 is closely fitted upon and engages the tube in a vertically disposed path and also is engaged with the interior wall of the cylindrically shaped housing 16 in a water tight seal. In other words, water cannot pass between the tube 10 and the plate 18 or between the housing 16 and the plate 18. Rather, the water must travel the serpentine path and in like manner, air which is to be drawn in must enter at the lower open end of the housing, follow this serpentine path to the upper end and down the interior tube. Expelled air must travel up the tube and down the serpentine path and exit the device at the open lower end.

This prior art snorkel works upon the theory that air will be drawn in and expelled at the lower opening 20 when the housing is disposed above the surface of the water. When the user dives or otherwise submerges to a lower depth, the cylindrically shaped housing 16 becomes submerged below the surface of the water. While the water may travel somewhat upwardly along the serpentine path, it is theorized that the water will not enter the breathing tube due to the pressure of the air which is already in the breathing tube. In like manner, it is theorized that when the diver raises to the surface, or at least approaches the surface, the housing 16 will be raised above the water surface whereby any water trapped in the housing will follow the serpentine path and exit through the opening 20.

While this prior art device may be partially effective, it has many serious drawbacks. First of all, there is no assurance that water cannot enter the breathing tube 10. In fact, if the user blows hard and attempts to expel water or stale air with any substantial amount of force, there will be little or no air pressure to prevent water from moving into the breathing tube 10. In addition, due to the fact that the air being expelled and the air taken in must travel along the same serpentine path, the user must expel with a fair amount of force and must also inhale with a substantial amount of force. This creates a danger in that the user may also inhale water which may be located in the housing 16.

Another one of the problems inherent with the prior art snorkel P was the long tube and insufficient diameter which thereby restricted air flow. Further, the lengthy serpentine path generated a very substantial amount of friction and resultant resistance. As a result, air flow was substantially restricted and, moreover, it was difficult to expunge water from the tube during "blow-out" attempts.

FIGS. 2 through 5 illustrate various embodiments of a snorkel S1 constructed in accordance with and embodying the present invention. A preferred embodiment of the snorkel S1 is illustrated in FIGS. 2 and 3. The snorkel S1 of the present invention comprises an outer cylindrically shaped housing 30 having a cylindrically shaped side wall 32 and an integrally formed bottom wall 34, and which form an internal chamber 36. The housing 30 is upwardly opening and the chamber 36 communicates with the external atmosphere through an air inlet and exit aperture or opening 38.

Extending through the bottom wall 34 of the housing 30 is a vertically disposed stub tube 40 which forms part of or is connected to an elongate vertically disposed breathing tube 42 as hereinafter described. The stub tube 40 is connected to the breathing tube 42, in the embodiment as illustrated, through a swivel joint 44 which is also hereinafter described in more detail. Otherwise, if the swivel joint 44 were not present, the stub tube would be a part of and integral with the elongate breathing tube 42.

At its lower end, the breathing tube 42 is provided with an integrally formed somewhat U-shaped section 46. Mounted on the outer end of the U-shaped section 46 is a mouth piece 48 which is adapted for engagement by the teeth and the lips of the user. This mouthpiece is conventional in its construction and when engaged by the user, is restrained and forms with the lips an air tight passageway through the tube for the expelling and inhalation of air through the breathing tube 42.

The snorkel of the present invention also comprises a secondary tube 50 which is connected to the upper end of the elongate breathing tube 42 through an inverted U-shaped section 52. In the embodiment as illustrated, the U-shaped section 52 is integral with the upper end of the vertically disposed secondary tube 50 and is fitted onto the upper end of the breathing tube 42 with a fluid tight seal. The secondary tube 50 is generally parallel to the breathing tube 42 and is connected to the chamber 36 of the housing 30 through an L-shaped section 54 at its lower end. It can be observed that the L-shaped section 54 extends into the housing 30 through a port 56. In many cases, it can be envisioned that the L-shaped section 54 may actually be in the form of a U-shaped section. In either embodiment, the L-shaped section which connects the lower end of the secondary tube 50 to the housing 30 is deemed to be an L-shaped section whether it is actually envisioned to be U-shaped are L-shaped in cross-sectional shape.

The swivel joint 44 is generally conventional in its construction and is therefore neither illustrated nor described in any further detail herein. However, this joint operates in such manner that it permits the breathing tube 42 to be turned relative to the stub tube 40 so that an air communication is maintained and in such manner that the fluid tight seal is created. In other words, there is no breach of integrity of the fluid seal and no water leak through any of the tubes.

In use, the user of this snorkel engages the mouth piece 48 and when the air inlet and outlet opening 38 is above the surface of the water, the snorkel is used in a conventional fashion. However, when the diver submerges to a depth such that the opening 38 is below the water surface, it can be observed that water can enter into the chamber 36 and above the port 56. However, due to the fact that air would be present in the breathing tube, the water generally will not rise above the neck 58 in the U-shaped section 52. Thus, there is no possibility of water inhalation by the user.

If the swimming attitude of the user should change, and the user dives, for example, it is still unlikely that any water which may be accumulated in the secondary tube 50 could pass over the neck 58 and into the stub tube 40 and the breathing tube 42. Relative positioning of the snorkel with respect to the water surface is hereinafter described in more detail.

FIG. 4 is a vertical sectional view of a simplified form of snorkel S2 constructed in accordance with and embodying the present invention. In this case, the snorkel S2 includes an elongate breathing tube 60 which may be provided with a mouth piece (not shown) at its lower end. At its upper end, the breathing tube 60 integrally merges into an upper tube section 62, which, in turn integrally merges into a vertically disposed secondary tube 64, in the manner as illustrated in FIG. 4. The vertically disposed secondary tube 64 also integrally merges into a lower tube section 66. Lower tube section 66 merges into chamber 67 formed by housing 71.

By further reference to FIG. 4, it can be observed that the snorkel S2 of the invention also operates somewhat in the manner of an S-trap. If the vertically disposed breathing tube 60 were located to the left of the secondary tube 64 so as not to be, in effect, folded upon itself, more of an S-shaped arrangement would be achieved. Nevertheless, the snorkel in this embodiment is also highly effective in that it can be manufactured at a relatively low cost but which is also highly effective in operation.

FIG. 5 illustrated an embodiment of a snorkel S3, which is similar to the snorkel S2, and includes the same major overall components. However, in this case, the vertically disposed breathing tube 80 integrally merges into a bulbous enlarged upper end 82. This enlarged bulbous upper end 82 is formed with a somewhat vertically disposed leg 86 having an open upper end 88. Again, a chamber is formed involving lower portions of the leg 86 and the secondary tube 84. Nevertheless, this embodiment of the snorkel S3 operates much in the same manner as the embodiment S2.

The snorkel embodiment S3 is highly effective in that it has a somewhat upwardly tapered shape. In effect, there appears to be a single housing which tapers upwardly and outwardly. In this way, the entire snorkel appears to be more streamlined and this is advantageous not only from an aesthetic standpoint, but also in avoiding entanglement with seaweed or other foliage on the ocean bed. The design of the snorkel S3 renders this unit to be more water dynamic. Furthermore, there is less possibility of snagging on some obtrusive object beneath the surface of the water.

FIGS. 6–8 of the drawings illustrate the operation of the snorkel in use. For the purposes of simplicity and ease of understanding, the snorkel S2 has been illustrated in FIGS. 6 through 8. FIG. 6 illustrates the arrangement where the snorkel has a major portion thereof located above the water surface, but which may have been submerged for a period of time. In this case, it can be observed that water may be located within the chamber of the snorkel but that there is a clear air passage way for the user, that is, air can enter through the opening 70 and can immediately pass above the surface of the water directly to the secondary tube 64 and into the breathing tube 60.

FIG. 7 illustrates the users attitude in a true horizontal position but with the snorkel completely submerged. In this case, due to the air which has been captured in the breathing tube, it can be observed that the water level in the seconday tube is far below the upper end of the breathing tube. Consequently, there is little chance for the diver to inhale any of the water. FIG. 8 illustrates the attitude of the diver when the diver has either dived to a further depth or started to surface. Nevertheless, the entire head of the snorkel is below the water surface. It can be observed that water may only rise in the secondary tube up toward the upper end of the secondary tube but not completely to the point where it would pass into the breathing tube.

Thus, there has been illustrated and described a unique and novel snorkel which can be used in a variety of swimming attitudes and which precludes an inhalation of water by a user. Thus, the present invention fulfills all of the objects and advantages sought therefore. It should be understood that many changes, modifications, variations and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention which is limited only by the following claims.

Having thus described my invention, what I desire to claim and secure by letters patent is:

1. A snorkel capable of use in underwater swimming where the attitude of the swimmer can vary substantially, said snorkel comprising:

(a) a housing forming a chamber with a combined inlet and outlet opening which is upwardly presented when a user is in a normal swimming attitude and said snorkel housing is in an upright generally vertical disposition, (b) an elongate breathing tube extending through said housing and having a lower end and an upper end, said upper end being located upwardly of the opening of said chamber when the user is in a normal swimming attitude, (c) a secondary tube having an upper end and a lower end, (d) a lower tube section connecting the lower end of said secondary tube to the chamber of said housing, (e) an upper tube section connecting the upper end of said breathing tube to the upper end of said secondary tube, said secondary tube having a relatively straight section arranged so that water may accumulate therein, but having a length sufficient so that water cannot pass from the secondary tube through the upper section into the elongate breathing tube when the snorkel is tilted with respect to an upright generally vertical disposition, such that water inhalation by a user is precluded when the attitude of the diver is changed so that the elongate tube is not vertically disposed, and (f) a mouthpiece on the lower end of said elongate breathing tube and adapted to be received at a mouth of a user of said snorkel.

2. The snorkel of claim 1 further characterized in that said housing has a substantially larger cross-sectional area in a generally horizontal plane than said elongate breathing tube when said snorkel is in an upright generally vertical disposition.

* * * * *